United States Patent [19]

Hayes

[11] Patent Number: 4,905,631

[45] Date of Patent: Mar. 6, 1990

[54] MOISTURE SEPARATOR REHEATER WITH INLET DIFFUSER FOR STEAM DISTRIBUTION

[75] Inventor: James K. Hayes, Chattanooga, Tenn.

[73] Assignee: Combustion Engineering, Inc., Windsor, Conn.

[21] Appl. No.: 316,158

[22] Filed: Feb. 27, 1989

[51] Int. Cl.[4] ..... F22G 1/00

[52] U.S. Cl. ..... 122/483; 122/488; 122/491

[58] Field of Search ..... 122/483, 486, 488–492

[56] References Cited

U.S. PATENT DOCUMENTS

| | | | |
|---|---|---|---|
| 2,368,443 | 1/1945 | Biery | 122/491 |
| 3,574,303 | 4/1971 | Rabas | 122/483 |
| 4,494,486 | 1/1985 | Mendler | 122/491 |
| 4,675,963 | 6/1987 | Franzolini et al. | 122/491 X |
| 4,714,054 | 12/1987 | Minard et al. | 122/483 |

*Primary Examiner*—Edward G. Favors

*Attorney, Agent, or Firm*—Chilton, Alix & Van Kirk

[57] ABSTRACT

The wet steam flow distribution section (20) of the moisture separator reheater (10) includes a multiplicity of side-by-side spaced-apart channel bars (52,54,56) extending transversely to the direction of steam flow from the distribution section to the moisture separator section (24). The bars are preferably substantially U-shaped in section, whereby the two leg portions (60,62) of each bar may be angled and slightly spaced apart from confronting leg portions of adjacent bars, thereby defining respective diffuser nozzles (64). Each nozzle has a discharge end cross-section elongated in the direction parallel to the bars, for directing wet steam toward the separator section. The spacing (Y) and other design variables associated with the bars, permit optimization and uniformity of flow over the full axial extent of the moisture separator reheater unit with minimum pressure drop across the steam distribution apparatus.

14 Claims, 5 Drawing Sheets

MOISTURE SEPARATOR REHEATER WITH INLET DIFFUSER FOR STEAM DISTRIBUTION

BACKGROUND OF THE INVENTION

The present invention relates to moisture separators, and more particularly, to the optimization of the flow distribution of wet steam into the separator components of a moisture separator reheater.

Moisture separator reheaters (MSR) are commonly used in industrial processes, particularly in nuclear power plants. Typically, the MSR is a horizontally oriented, elongated shell containing an entrance plenum, a wet steam distribution section, a moisture separating section, a reheating section and an exit plenum.

Particularly in MSRs that were installed in early nuclear power plants, the distribution of wet steam into the separator section has exhibited undesirable variations in the flow rate into the separators. Many of these older MSR's use demister pads in the moisture separating section, and the inability to produce uniform flow results in locally excessive flow velocity into the pads, causing damage such as pad blowout, moisture carry-through, and unbalanced steam flow through the reheater section.

SUMMARY OF THE INVENTION

It is thus an object of the present invention to provide a moisture separator reheater unit having a flow distribution section which achieves a more uniform wet steam flow rate into the demoisturizer section.

It is another object to provide a steam inlet flow distribution apparatus for a moisture separator reheater that can be backfit into existing flow distribution sections with minimal reworking in the field.

It is still a further object that the distribution section be capable of being "tuned" to the specific characteristics of a particular MSR.

These objects are accomplished in accordance with the present invention by providing a multiplicity of side-by-side, spaced-apart bars extending transversely to the direction of steam flow from the distribution section to the separator section, the bars defining a respective multiplicity of diffuser nozzles. Each nozzle has a discharge end having a cross-section elongated in the direction parallel to the bars, for directing wet steam toward the separator section. Preferably, the bars are in the form of channel bars having a substantially U-shaped cross-section. The two leg portions of a given channel may be angled slightly toward each other, such that the spaced-apart legs of adjacent channel bars are flared outwardly relative to each other, thereby forming a diffuser gap for achieving a diverging outlet steam flow.

The multiplicity of bars can be arranged in a plurality of distinct zones in the shell axial direction, the nozzles within each zone being substantially identical, but different from the nozzles in at least one other zone. The nozzles in one zone can differ from the nozzles in another zone by at least one variable of the group of channel member variables consisting of the distance between the base portions of adjacent channel bars, the angle of the leg portions, the lengths of the leg portions, and the width of the base portion in the direction transverse to the flow of steam through the nozzles. Preferably, the angle of each leg portion is within the range of about two to seven degrees relative to the vertical.

The wet steam distribution section in accordance with the invention can be further "tuned" within each zone by varying, for example, the gap, to provide uniform flow rates through each diffuser nozzle. With diverging steam flow exiting each diffuser, a uniform steam velocity will enter the wire mesh demisters throughout the length of the MSR with minimum pressure drop across the diffusers.

BRIEF DESCRIPTION OF THE DRAWINGS

The preferred embodiment of the invention is described below with reference to the accompanying drawings, in which.

DESCRIPTION OF THE PREFERRED EMBODIMENT

Figure 1:
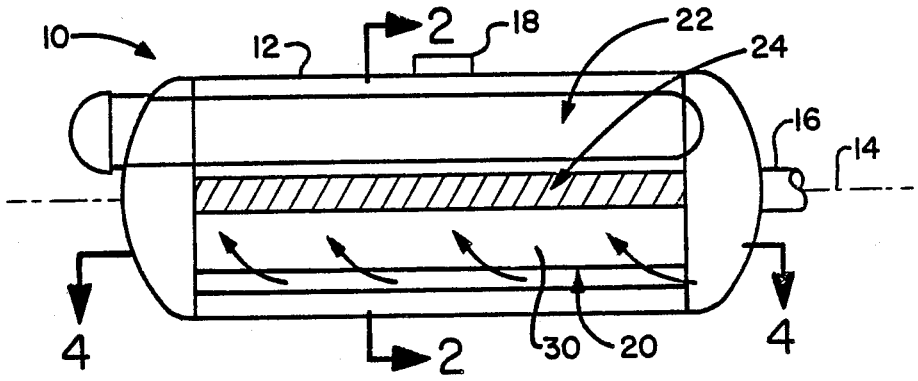
FIG. 1 is a schematic longitudinal view of a typical moisture separator reheater.
Figure 2:
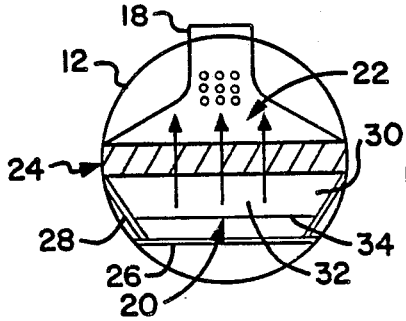
FIG. 2 is a cross section view taken along line 2—2 of FIG. 1.

FIGS. 1 and 2 show a typical moisture separator reheater unit 10 used in a nuclear power plant, comprising a substantially cylindrical, closed vessel 12 oriented about a horizontal axis 14, and having a wet steam entrance 16 and a dry, heated steam exit plenum 8. The unit comprises three major sections, consisting of the wet steam flow distribution section 20, the moisture separator section 24, and the reheater section 22, as is well known in the art. When viewed in cross section (FIG. 2), the flow distribution section 20 is supported above a bottom plate 26 and within lateral plates 28. Steam flow from the entrane plenum 16 fills the inlet chamber 32 and rises through distribution structure in volume 30, from which it flows upwardly through wire mesh or similar demisters where the water separation occurs at 24. The dried steam then passes upwardly through a generally funnel-shaped reheater section 22 containing a plurality of hot tubes.

Figure 3:
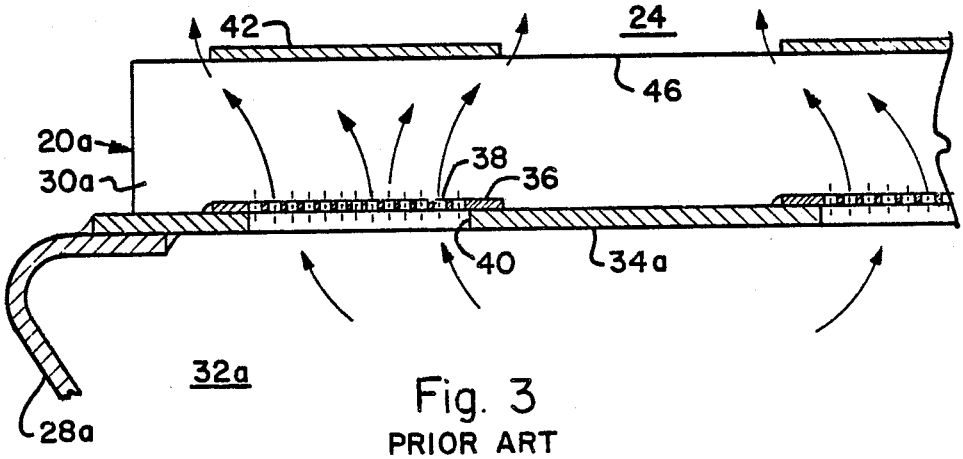
Fig. 3 PRIOR ART
FIG. 3 is a detail view of the portion of the flow distribution section of a prior art flow distribution section.

FIG. 3 is an enlarged view of the flow distribution section **20*a* of a conventional, older moisture separator reheater. The wet steam in inlet chamber 32 flows upwardly through large openings 40 in plate 34*a*, which is supported by structure 28*a*. A perforated plate 36 is secured over each opening 40, forcing the steam through holes 38, and diffusing it upwardly through the space 30***a* immediately above plate 34*a*. The steam flowing upward impinges on a plurality of deflector plates 42 located substantially above the perforated plates 36. Openings 46 between the deflector plates 42 enable the steam flow to rise and enter the demister mesh region 24. The arrangement of openings 40, perforated plates 36, deflector plates 42 and openings 46, was established to achieve some degree of uniformity of the wet steam flow entering the demister region 24. This distribution has been measured in a variety of locations immediately above openings 46, and found to often deviate significantly from the design target for the steam velocity impinging on the mesh in sections 24.

Figure 4:
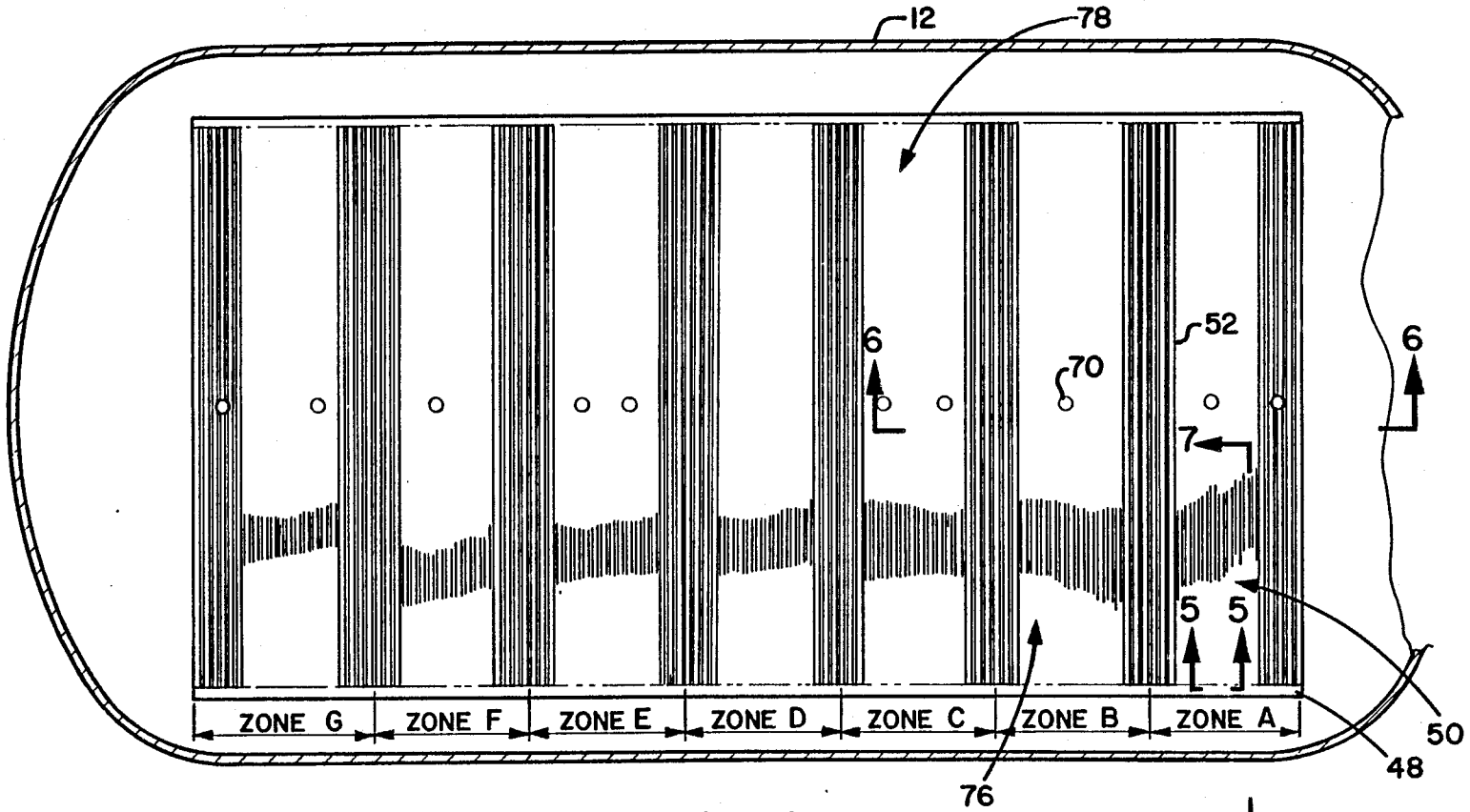
FIG. 4 is a section view taken along line 4—4 of FIG. 1, showing the preferred embodiment of the invention as back-fit in a typical moisture separator reheater.

In accordance with the invention shown in FIG. 4, the arrangement shown in FIG. 3 is replaced with a multiplicity of side-by-side spaced-apart bars such as 52 extending transversely to the direction of steam flow from the distribution section to the separator section. The bars are grouped according to zones A–G, the bars within each zone defining a respective bank 50 of substantially uniform diffuser nozzles. The nozzles in bank 50 extend in an elongated direction transverse to the shell axis, and, when viewed from above as shown in FIG. 4, appear as side-by-side rectangular gaps.

Figure 5:
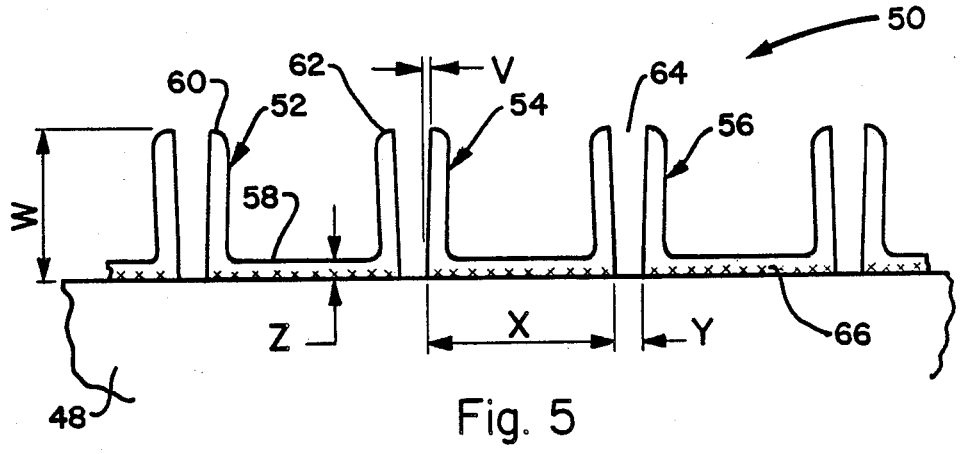
FIG. 5 is a section view taken along line 5—5 of FIG. 4, showing the preferred arrangement of a plurality of channel bars defining a portion of one zone of the distribution section in accordance with the invention.

The preferred form of the bars is shown in FIG. 5, where each bar is a substantially U-shaped channel bar such as 52,54,56, having a base portion 58, a left leg 60, and a right leg 62. The legs of adjacent bars such as 54,56 are juxtaposed to define one gap 64 which functions as a diffuser nozzle. The legs 60,62 of a given channel bar 52,54 may be angled slightly toward each other, at an angle V in the range of two to seven degrees relative to the vertical.

As shown in FIGS. 4, 5, 7, 8 and 9, the channel bars are welded at 66 on one end to a substantially horizontally oriented support surface 48 that extends the length of the shell, adjacent the shell wall 12, and typically being connected to support member 28*b*. Each bar is welded at its outer end to support surface 48 near the shell wall 12, and the inner end is welded to a central plate 68 that traverses the flow distribution section axially below the shell centerline. The steam flow rising through the nozzle banks 50, is then distributed at the substantially uniform, desired flow rate throughout the unit onto the underside of the demister section 24. Typically, as also shown in FIGS. 4 and 6, a plurality of vertically oriented support bars 70 may also be utilized to space and support the distribution section relative to the vessel 12.

The channel bars are typically available in various sizes as off-the-shelf items. This provides for an inexpensive modularity which permits great flexibility in defining the flow characteristics of the steam passing through each nozzle formed thereby. For example, the width X of each base portion 58, and the gap distance Y between bases of adjacent channel bars, can be easily measured and established, either during construction of original MSR units in the shop, or in back-fitting a replacement distribution section from the field. The length W of each leg 60,62 can easily be specified from the source of the channel bars, and a variety of such lengths may be available on site to optimize selection.

Figure 6:
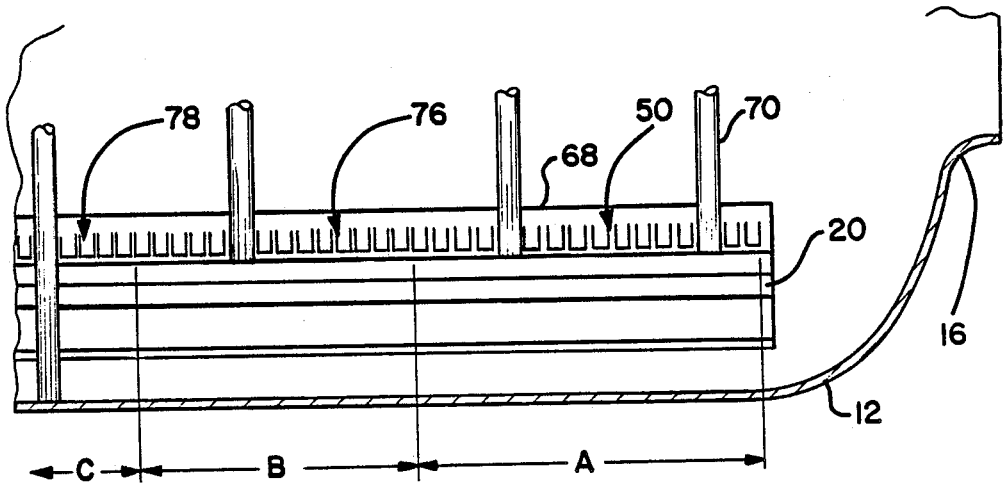
FIG. 6 is a section view taken along line 6—6 of FIG. 4, showing the differences in the channel bars among three zones of the distribution section in accordance with the invention.
Figure 7:
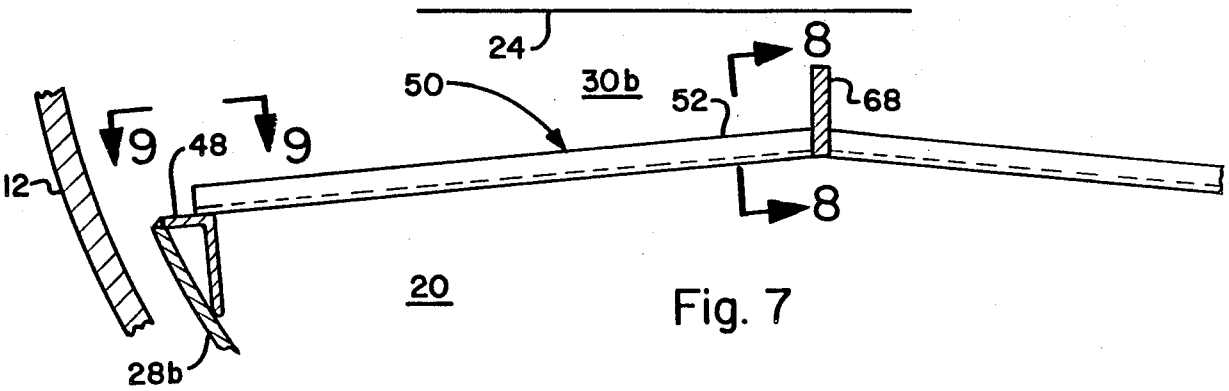
FIG. 7 is a section view taken along line 7—7 of FIG. 4, showing a channel bar in elevation and its support within the shell of the moisture separator reheater.
Figure 9:
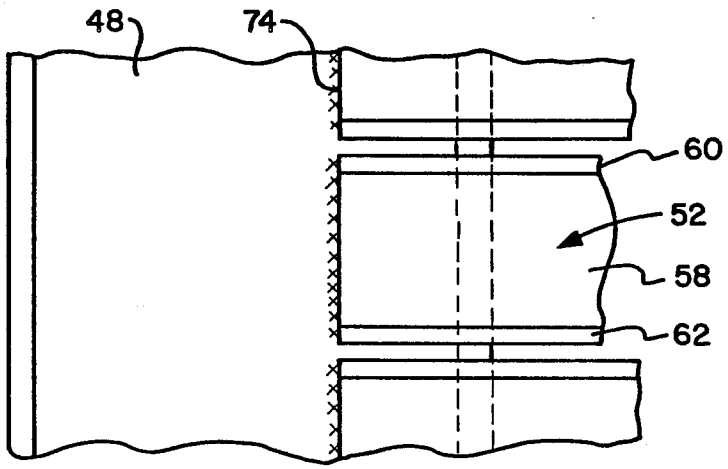
FIG. 9 is a top view along line 9—9 of FIG. 7 showing another feature of the connection of the channel bars to the support structure in the moisture separator reheater.
Figure 8:
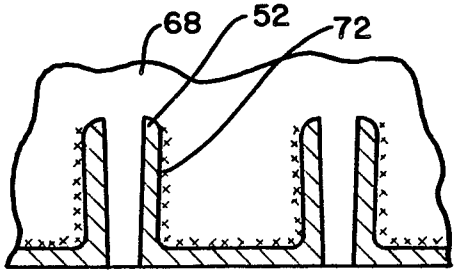
FIG. 8 is a section view taken along line 8—8 of FIG. 7.

As shown in FIG. 6, the physical characteristics of the channel bars within each zone A, B . . . G can differ from the characteristic of nozzles in another zone, by at least one variable including the distance Y between base portions 58 of adjacent channel bars, the angle V of the leg portions 60,62, the length W of the leg portions, and the width X of the base portions in the direction transverse to the flow of steam through the nozzle. In FIG. 6, the difference between the channel bars 50,76,78 associated with zones A, B, and C, respectively, is the gap between the channel bars. At least in some circumstances, only this gap width Y need be varied between zones.

Figure 10:
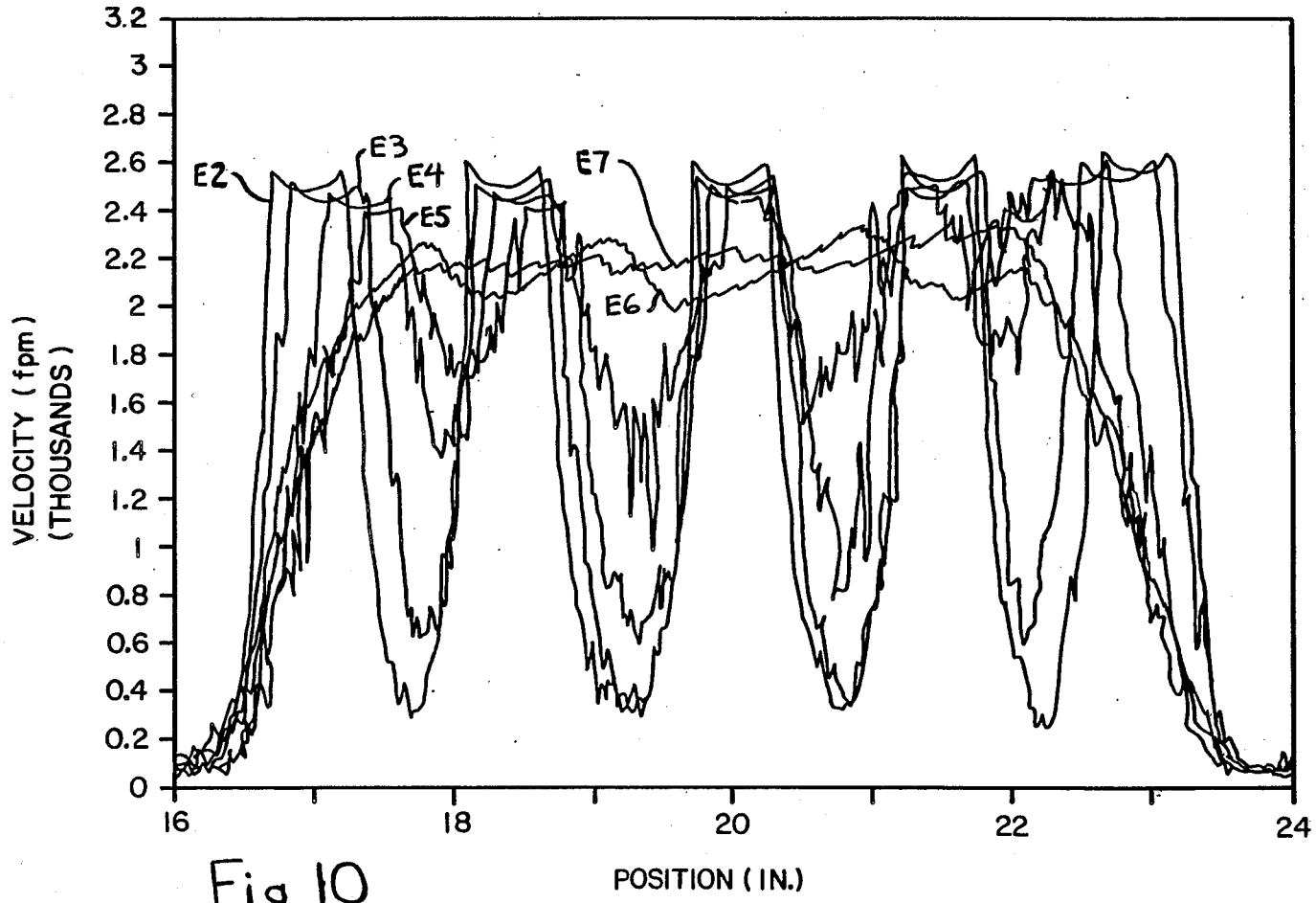
FIG. 10 is a graph of velocity profiles above the diffusers at various elevations.

The height of the legs and the angle of the diffusers should normally be sized to prevent a stalled condition. This is a condition of local flow reversal at the outlet end of the diffusers. However, the most important feature is to have a uniform steam flow at the demister, which is approximately 18 inches above the diffusers. It is typically desired that the mean steam velocity at the entrance to the demister, be about 5.6 feet per second. Testing has demonstrated that when the invention as described is installed as a retrofit in a typical MSR of the type shown generally in FIG. 1, the steam exiting the diffusers will diverge so that a uniform steam velocity will exist at the entrance of the demisters. FIG. 10 is a graph of velocity profile above a diffuser. E2 is 5 inches above the diffuser, E7 is 10 inches above the diffuser. Jetting of air occurs at lower elevations but not at upper elevations.

Uniform steam flow can be achieved by gradually reducing the gap between the channels as one progresses axially within the MSR from the steam entrance. Thus, the distribution section can be designed to accommodate the axially varying static pressure that exists in the inlet plenum so as to achieve uniform steam flow to the demister and reheater tube bundle throughout the length of the MSR. For example, variation in the gap between diffusers can range from about 0.050 inches (zone G) to 0.350 inches (zone A). A 1.25 inches wide channel with one inch legs and a 2° angle V would represent a typical embodiment. It is also possible to fine-tune by varying gaps within zones. For example, in a system with 250 channels it may be desirable to change gaps after every 10 channels.

It can be appreciated that a number of modifications and variations to the preferred embodiment described and shown herein can be made without departing from the spirit and scope of the invention as defined by the appended claims.

I claim:

1. A moisture separator reheater comprising:

an elongated, substantially closed shell having a longitudinal axis, a wet steam inlet, and a dry steam outlet;

a wet steam distribution section fluidly connected to the wet steam inlet and extending axially within substantially the full length of the shell;

a heating section extending axially within substantially the full length of the shell, for raising the steam temperature as the steam passes from the distribution section to the outlet;

a separator section extending axially within substantially the full length of the shell and situated between the distribution section and the heating section, for drying the wet steam as it exits the distribution section, said distribution section including a multiplicity of side-by-side bars extending transversely to the direction of steam flow from the distribution section to the separator section, the bars defining a respective multiplicity of diffuser nozzles, each nozzle having a substantially rectangular cross section elongated in the direction parallel to the bars, for directing wet steam toward the separator section.

2. The moisture separator reheater of claim 1, wherein the multiplicity of bars are arranged in a plurality of distinct zones in the shell axial direction, the nozzles within each zone being substantially identical but different from the nozzles in at least one other zone.

3. The moisture separator reheater of claim 1, wherein each bar is in the form of a channel member having a substantially "U" shaped cross section defined by a base portion and two leg portions projecting from the base portion, the nozzles being formed by the juxtaposed leg portions of adjacent channel members.

4. The moisture separator reheater of claim 3, wherein the two leg portions of each channel member are angled slightly toward each other such that the respective nozzles formed by adjacent channel members are flared outwardly in the direction of steam flow.

5. The moisture separator reheater of claim 4, wherein the multiplicity of bars are arranged in a plurality of distinct zones in the shell axial direction, the nozzles within each zone being substantially identical but different from the nozzles in at least one other zone.

6. The moisture separator reheater of claim 5, wherein the nozzles in one zone differ from the nozzles in another zone by at least one variable of the group of channel member variables consisting of the distance between the base portions of adjacent channel members, the angle of the leg portions, the lengths of the leg portions, and the width of the base portion in the direction transverse to the flow of steam through the nozzle.

7. The moisture separator reheater of claim 4, wherein the angle of each leg portion is within the range of about zero to seven degrees from vertical.

8. The moisture separator reheater of claim 1, wherein the nozzles within each zone produce a zone average steam velocity at the surface of the separator section, which is within a predetermined acceptable deviation relative to the average steam velocity at said surface produced by all of the zones.

9. The moisture separator reheater of claim 3, wherein the nozzles throughout the MSR produce essentially a uniform steam mass flow rate through each diffuser.

10. The moisture separator reheater of claim 1, wherein the shell is horizontally oriented, the flow distribution section is at the bottom, the separator section in the middle, and the heater section at the top of the shell as viewed in cross section, said bars being oriented substantially horizontally and transverse to the shell longitudinal axis.

11. In a moisture separator reheater of the type having a wet steam flow distribution section upstream of a moisture separator section, the improvement comprising said flow distribution section including a multiplicity of side-by-side, spaced apart bars extending transversely to the direction of steam flow from the distribution section to the separator section, the bars defining a respective multiplicity of diffuser nozzles, each nozzle having a discharge end cross section elongated in the direction parallel to the bars, for directing wet steam toward the separator section.

12. The improvement of claim 11, wherein the bars are in the form of channel members having a substantially "U" shaped cross section.

13. The improvement of claim 11, wherein each bar is in the form of a channel member having a substantially "U" shaped cross section defined by a base portion and two leg portions projecting from the base portion, the nozzles being formed by the juxtaposed leg portions of adjacent channel members.

14. The improvement of claim 13, wherein the two leg portions of each channel member are angled slightly toward each other such that the respective nozzles formed by adjacent channel members are flared outwardly in the direction of steam flow.

* * * * *